US008723452B2

(12) United States Patent
Ryding et al.

(10) Patent No.: US 8,723,452 B2
(45) Date of Patent: May 13, 2014

(54) D.C. CHARGED PARTICLE ACCELERATOR AND A METHOD OF ACCELERATING CHARGED PARTICLES

(75) Inventors: Geoffrey Ryding, Manchester, MA (US); Steven Richards, Georgetown, MA (US); Paul Eide, Stratham, NH (US); Theodore H. Smick, Essex, MA (US); Malcolm Barnett, East Preston (GB)

(73) Assignee: GTAT Corporation, Merrimack, NH (US)

( * ) Notice: Subject to any disclaimer, the term of this patent is extended or adjusted under 35 U.S.C. 154(b) by 203 days.

(21) Appl. No.: 13/186,513

(22) Filed: Jul. 20, 2011

(65) Prior Publication Data

US 2012/0146555 A1 Jun. 14, 2012

Related U.S. Application Data

(63) Continuation-in-part of application No. 12/962,723, filed on Dec. 8, 2010.

(51) Int. Cl.
*H05H 7/22* (2006.01)

(52) U.S. Cl.
USPC ..... 315/506; 315/500

(58) Field of Classification Search
USPC ..... 315/500, 506
See application file for complete search history.

(56) References Cited

U.S. PATENT DOCUMENTS 3,484,866 A * 12/1969 Kawai et al. ..... 363/61
4,383,180 A 5/1983 Turner
5,124,658 A * 6/1992 Adler ..... 315/500
5,325,284 A * 6/1994 Stephenson ..... 363/59
6,653,642 B2 11/2003 Pedersen et al.
2005/0200320 A1 9/2005 Korenev
2009/0224701 A1 9/2009 Morita et al.
2010/0033115 A1 2/2010 Cleland et al.
2010/0301985 A1 12/2010 Luo et al.

OTHER PUBLICATIONS

Office Action dated Dec. 26, 2012 for U.S. Appl. No. 12/962,723.
International Search Report and Written Opinion dated Jul. 9, 2012 for PCT Application No. PCT/US2011/062531.
Weisser, D. "Voltage Distribution Systems—Resistors and Corona Points." Electrostatic Accelerators: Fundamentals and Applications. The Netherlands: Springer, 2005. p. 110-22.
U.S. Appl. No. 12/494,269, filed Jun. 30, 2009, entitled "Ion Implantation Apparatus".
Notice of Allowance and Fees dated Jun. 28, 2013 for U.S. Appl. No. 12/962,723.

* cited by examiner

*Primary Examiner* — Alexander H Taningco
*Assistant Examiner* — David Lotter
(74) *Attorney, Agent, or Firm* — The Mueller Law Office, P.C.

(57) ABSTRACT

A d. c. charged particle accelerator comprises accelerator electrodes separated by insulating spacers defining acceleration gaps between adjacent pairs of electrodes. Individually regulated gap voltages are applied across each adjacent pair of accelerator electrodes. In an embodiment, direct connections are provided to gap electrodes from the stage points of a multistage Cockcroft Walton type voltage multiplier circuit. The described embodiment enables an ion beam to be accelerated to high energies and high beam currents, with good accelerator stability.

6 Claims, 3 Drawing Sheets

D.C. CHARGED PARTICLE ACCELERATOR AND A METHOD OF ACCELERATING CHARGED PARTICLES

REFERENCE TO RELATED APPLICATIONS

This application is a continuation-in-part of application Ser. No. 12/962,723 filed 8 Dec. 2010, the disclosure of which is incorporated herein by reference in its entirety for all purposes.

BACKGROUND

1. Field of the Invention

This invention relates to a d. c. charged particle accelerator. The invention is applicable to an accelerator for accelerating positive ions in ion implantation apparatus.

2. Background Information

Ion implantation may require the production of ion beams at high energies and high beam current. D. c. accelerators are known to be used in ion implanters for providing the required beam energy.

In a known charged particle accelerator, a number of accelerator electrodes define successive acceleration gaps. The accelerator electrodes are biased at regular voltage intervals to control the voltage gradient along the length of the accelerator. Bias voltages for the accelerator electrodes are derived from a potential divider connected to a high voltage generator providing the full accelerator potential, which may for example be several hundred kilovolts or in excess of one megavolt. A known high voltage generator for this purpose is a Cockcroft Walton voltage multiplying circuit.

There are challenges in designing a d. c. particle accelerator which can operate at relatively high energies and also maintain good stability at high beam currents.

BRIEF SUMMARY OF THE INVENTION

In one embodiment, the invention provides a d. c. charged particle accelerator comprising acceleration electrodes including end electrodes and at least N−1 intermediate electrodes. The acceleration electrodes define at least N acceleration gaps between adjacent pairs of the electrodes, where N is at least 3. N d. c. voltage generators, which are d. c. isolated from each other, are each arranged to generate a respective one of N high voltage d. c. output voltages from input electric power delivered to the voltage generator. The N high voltage d. c. output voltages are connected to provide gap voltages across the N acceleration gaps. A d. c. isolating power delivery apparatus is arranged to deliver the input electric power to the N voltage generators while maintaining d. c. isolation between the voltage generators. The d. c. isolating power delivery apparatus is operative such that the input electric power delivered to the N d. c. voltage generators is voltage regulated input electric power, whereby the N high voltage d. c. output voltages are respective regulated high voltage d. c. output voltages.

Then each of the N d. c. voltage generators may be operative to generate a respective regulated high voltage d. c. output voltage in direct proportion to the voltage regulated input electric power. The N regulated output voltages may have a common value $V_{gap}$.

The N d. c. voltage generators and the d. c. isolating power delivery apparatus may be constituted by a step-up transformer having a primary winding and a secondary winding. Each of the windings has respective winding end terminals, an inverter connected to the primary winding and is operative to supply a regulated a. c. voltage across the end terminals of the primary winding to produce an a. c. voltage between the end terminals of the secondary winding having a predetermined peak-to-peak voltage value. A voltage multiplier ladder may be formed of diodes and capacitors and connected to the secondary winding end terminals. The ladder may have N stages providing N stage points and operative to provide at each of the N stage points a respective d. c. voltage at a respective multiple (n) of the predetermined regulated peak to peak a. c. voltage value, where n is 1, 2 . . . N. A connection from each stage point may be provided to a respective one of the acceleration electrodes to connect the N regulated high voltage d. c. output voltages as the gap voltages across the N accelerator gaps.

In a further embodiment, the invention provides a d. c. charged particle accelerator comprising acceleration electrodes including end electrodes and at least N−1 intermediate electrodes. The acceleration electrodes define at least N acceleration gaps between adjacent pairs of the electrodes, where N is at least three. A Cockcroft Walton (CW) voltage multiplying circuit provides, from a regulated a. c. driving voltage having a predetermined peak to peak value, a high voltage d. c. power supply. The CW circuit has N stages providing N stage points each providing a respective d. c. voltage at a respective multiple (n) of the predetermined peak to peak value where n is 1, 2, . . . N. A connection from each stage point of the CW circuit may be provided to a respective one of the acceleration electrodes. In another embodiment, each of the connections between one of the stage points of the CW circuit and the respective one of the accelerator electrodes includes a respective current limiting resistor.

The invention also provides a method of accelerating charged particles using d. c. voltages, comprising the steps of providing acceleration electrodes including end electrodes and at least N−1 intermediate electrodes, the acceleration electrodes defining at least N acceleration gaps between adjacent pairs of the electrodes, where N is at least three; generating N high voltage d. c. output voltages which are electrically isolated from each other from input electric power; voltage regulating and delivering the input electric power while maintaining d. c. isolation between the high voltage d. c. output voltages, whereby the N high voltage d. c. output voltages are regulated, and applying the N regulated output voltages to the acceleration electrodes defining the N acceleration gaps to provide gap voltages across the N acceleration gaps.

The invention further provides a method for acceleration electrodes including end electrodes and at least N−1 intermediate electrodes, the acceleration electrodes defining at least N acceleration gaps between adjacent pairs of the electrodes, where N is at least three; and a Cockcroft Walton (CW) voltage multiplying circuit to provide, from a regulated a. c. driving voltage having a predetermined peak to peak value, a high voltage d. c. power supply, wherein the CW circuit has N stages providing N stage points each providing a respective d. c. voltage at a respective multiple (n) of the predetermined peak to peak value where n is 1, 2, . . . N; and connecting each the stage point of the CW circuit to a respective one of the acceleration electrodes.

BRIEF DESCRIPTION OF THE DRAWINGS

Examples of the invention will now be described with reference to the accompanying drawings, in which.

DETAILED DESCRIPTION OF THE INVENTION

Figure 1:
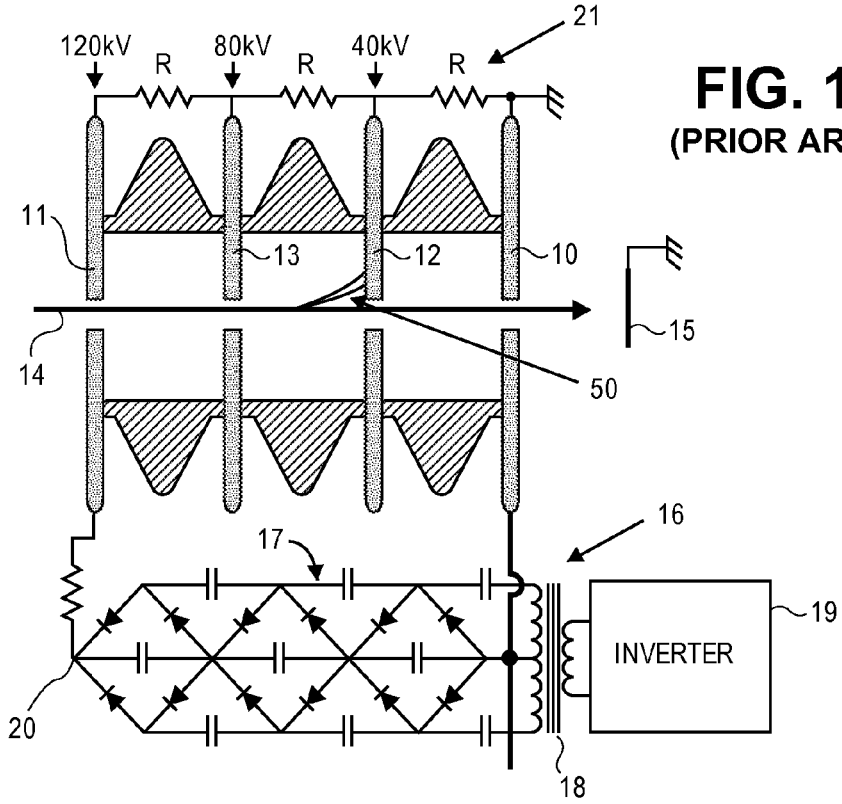
FIG. 1 (PRIOR ART)
FIG. 1 is a schematic representation of a prior art d. c. charged particle accelerator.

FIG. 1 is a schematic illustration of a typical prior art d. c. charged particle accelerator having just three acceleration gaps defined by end electrodes 10 and 11 and two intermediate electrodes 12 and 13. The electrodes 10, 11, 12 and 13, typically comprise apertured plates with the apertures in the plates aligned along a central axis, defined in the drawing by the line 14.

The end electrode 10, which is the right hand electrode in the drawing, may be held at ground potential, and increasing positive voltages applied to electrodes 12, 13 and 11 respectively. In a typical arrangement, these increasing positive voltages would define a common voltage drop ($V_{gap}$) across acceleration gaps between the adjacent pairs of electrodes. In the illustrated example, the common gap voltage $V_{gap}$ is 40 kV, so that the total voltage drop from the left hand end electrode 11 to the ground electrode 10 is 120 kV. Then positive charged particles or ions in a beam directed along the axis 14 from left to right in FIG. 1, will be accelerated by 120 keV when the beam emerges through the aperture in the ground electrode 10. The beam of accelerated positive ions may then be directed at a target 15. When the accelerated ion beam is used for ion implantation in semi-conductor manufacturing processes, the target 15 may be a target of semiconductor material. Accelerated ion beams are also used for processing semi-conductor wafers in order to enable thin laminae of silicon to be exfoliated from the surface of the wafer being processed. Apparatus for implanting high energy $H^+$ ions (protons) into silicon wafer substrates to provide exfoliated silicon laminae for use in the manufacture of solar cells, is disclosed in U.S. patent application Ser. No. 12/494,269 to Ryding et. al., which is assigned to the assignee of the present invention. The disclosure of this U.S. patent application is incorporated herein by reference in its entirety for all purposes.

In accordance with the prior art arrangement shown in FIG. 1, the required electrode voltages, here 40 kV, 80 kV and 120 kV are applied by a high voltage (h. v.) power supply unit indicated generally at 16. The power supply unit 16 is formed of a Cockroft Walton (CW) voltage multiplying circuit 17 powered by a transformer 18 from a high frequency inverter 19. The CW multiplier is formed of repeated stages of capacitors and full wave rectifier bridges, and the operation of this CW circuit is well understood by those skilled in the art.

As illustrated in the Figure, the transformer 18 has a secondary winding with a centre tap connected to ground (here via grounded end electrode 10). If the alternating voltage across each half of the secondary winding of the transformer winding 18 has a peak amplitude A, then the CW multiplier 17 which comprises three full wave rectifiers and associated capacitors, produces a d. c. output voltage at point 20 of 3×2 A. In the present example, the inverter 19 and the transformer 18 produce an output from each half of the secondary winding having a peak amplitude A=20 kV, so that the d. c. voltage generated at point 20 is 120 kV. In order to keep the reactive components of the CW multiplier 17 and also the transformer 18 as small as possible, the inverter 19 is arranged to drive the transformer primary at a frequency of several KHz, typically 30 KHz.

In accordance with standard practice for this prior art d. c. charged particle accelerator, the output of the CW multiplier 17 is connected to the end electrode of the accelerator at the highest potential relative to ground, shown here as left hand end electrode 11. A connection from point 20 to the electrode 11 is made via a resistance of a few kilohms, in order to provide some over current protection to the multiplier 17.

In order to provide the appropriate voltages at intermediate electrodes 12 and 13, high value resistances R are connected in series between successive electrodes to provide a potential divider illustrated generally at 21. To minimize current drain through the potential divider formed by the series connected resistors R, these resistors have a high resistance value, typically some tens of megohms. This is theoretically quite satisfactory as there should be negligible current flow to or from the intermediate electrodes 12 and 13.

Figure 2:
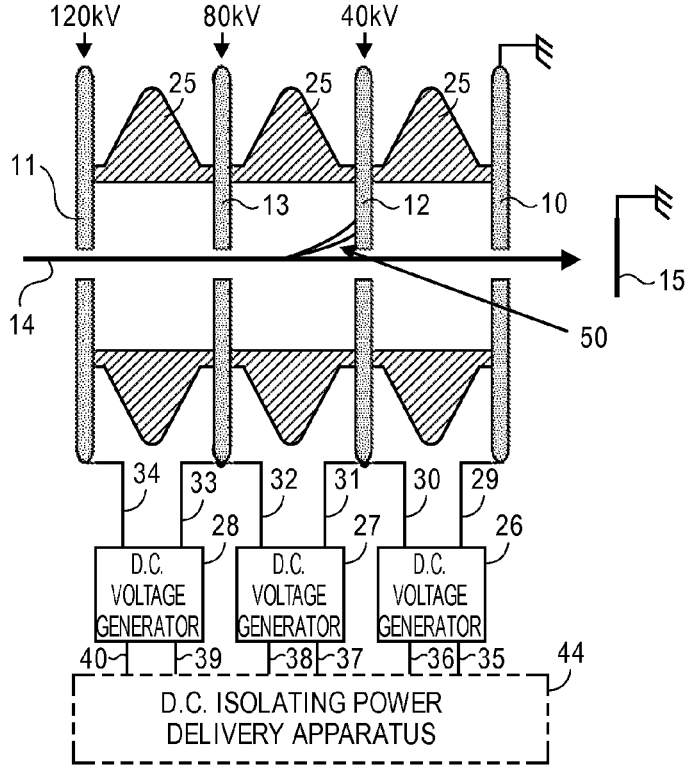
FIG. 2 is a schematic representation similar to FIG. 1 of a d. c. charged particle accelerator embodying the present invention.

FIG. 2 illustrates a d. c. charged particle accelerator which embodies the present invention. Elements of the construction illustrated in FIG. 2 which correspond to elements in the prior art arrangement of FIG. 1 are given the same reference numerals. Accordingly, the accelerator comprises end electrodes 10 and 11 together with intermediate electrodes 12 and 13 defining between them three acceleration gaps between adjacent pairs of electrodes. The electrodes are separated by insulating spacers, identified by reference numeral 25 in FIG. 2. A beam of charged particles is accelerated along the axis 14 to strike a target 15.

In the embodiment of FIG. 2, gap voltages are applied across successive adjacent pairs of the electrodes 10, 11, 12 and 13 by three d. c. voltage generators 26, 27 and 28. These d. c. voltage generators 26, 27 and 28 are electrically isolated from each other and each is shown having a pair of output lines 29 and 30, 31 and 32, and 33 and 34. The output lines are connected to respective adjacent pairs of the accelerator electrodes defining the three acceleration gaps, so that output lines 29 and 30 from generator 26 are connected to ground electrode 10 and the first intermediate electrode 12, output lines 31 and 32 from generator 27 are connected to intermediate electrodes 12 and 13, and output lines 33 and 34 of generator 28 are connected to intermediate electrode 13 and the high voltage end electrode 11.

Each of the d. c. voltage generators 26, 27 and 28 is shown having respective input lines 35 and 36, 37 and 38 and 39 and 40. Input electric power is delivered to the voltage generators along these input lines from a d. c. isolating power delivery apparatus 44. The d. c. isolating power apparatus 44 is arranged to deliver the required input electric power to the d. c. voltage generators 26, 27 and 28 while maintaining d. c. isolation between these voltage generators. The d. c. isolating power delivery apparatus 44 is operative such that the input electric power delivered to the d. c. voltage generators 26, 27 and 28 is voltage regulated input electric power. As a result, the output voltages from the d. c. voltage generators 26, 27 and 28 on the respective pairs of output lines 29 and 30, 31 and 32, and 33 and 34 are all regulated d. c. voltages.

Because the required input electric power is supplied to each of the voltage generators 26, 27 and 28, without compromising the d. c. isolation of these voltage generators, the output lines of the d. c. voltage generators can be connected as shown to the accelerator electrodes whereby the output lines of the generators are effectively connected in series. In this way, the required gap voltages are applied across the successive acceleration gaps of the accelerator.

The d. c. voltage generators 26, 27 and 28, together with the d. c. isolating power delivery apparatus 44 together operate so that the output voltages on the output lines of the d. c. voltage generators are all regulated voltages, providing respective defined gap voltages between the successive gaps of the accelerator. It can be seen, therefore, that the generators 26, 27 and 28 in combination with the d. c. isolating power delivery apparatus 44 provide a regulated d. c. high power voltage supply apparatus which has three pairs of output lines connected to respective adjacent pairs of the accelerator electrodes defining the three acceleration gaps. The regulated power supply apparatus is operative to provide three regulated high voltage d. c. output voltages which are electrically isolated from each other on the three pairs of output lines from the generators, to provide the required gap voltages across the three acceleration gaps.

Whereas the accelerators in FIGS. 1 and 2 are shown with just three acceleration gaps and are defined by end electrodes and two intermediate electrodes, the particle accelerator of the embodiments of the invention described with reference to FIG. 2 may be formed with more than three acceleration gaps, when required to provide an accelerated charged particle beam of higher energy.

It is normal in the design of d. c. charged particle accelerators for the successive acceleration gaps of the accelerator to have a uniform gap size, and for the applied gap voltage to be the same across each gap. However, this is not strictly essential and different gap sizes may be used in some circumstances, and/or differing regulated gap voltages may be applied across the various acceleration gaps.

By providing regulated output voltages from the generators 26, 27 and 28, across each of the three acceleration gaps illustrated in FIG. 2, the performance of the charged particle accelerator can be substantially enhanced.

Referring back to the prior art arrangement of FIG. 1, the voltage divider 21 providing gap voltages to the intermediate electrodes 12 and 13 is quite satisfactory in the absence of any current loading of the intermediate electrodes. However, in practice when the accelerator is used to accelerate an ion beam along the axis 14, some ions (charged particles) in the beam may strike one of the intermediate electrodes. Beam strike 50 on intermediate electrode 12 is illustrated in FIG. 1.

In the illustrated example of the prior art, the accelerator is used to accelerate a beam of positive ions, so that a beam strike onto electrode 12 causes positive current to flow from electrode 12 into the potential divider 21. Because of the relatively high value of the resistors R in the potential divider 21, a relatively small current resulting from beam strike 50 can have a very substantial effect on the voltage across the resistors R, and hence cause a substantial disturbance of the gap voltages in the accelerator.

In an example, the intended gap voltage across each of the accelerator gaps may be 40 kV and the value R of the resistors of the potential divider 21 may be 40 Mohm. In the absence of any beam strike current flowing in intermediate electrodes 12 and 13, the current flowing through the series connected resistors R of the potential divider 21 is 1 mA. If the ion beam along axis 14 is a high power beam of say 50 mA, a beam strike 50 of just 2% of this beam current can produce current of 1 mA flowing into the potential divider 21 from the electrode 12. Clearly this beam strike current has a very substantial effect on the voltages across each of the resistors of the potential divider 21. In fact, the voltage across the acceleration gap defined by electrodes 10 and 12 would increase by over 65%. In a practical accelerator in which gap voltages are set as high as possible within the limits of the spacings and insulation between electrodes, an increase in gap voltage of this magnitude would very likely cause a breakdown or arcing between adjacent electrodes, so that the stability of the accelerator is compromised.

This tendency to instability in d. c. accelerators is aggravated for relatively high powered beams and for accelerators with large numbers of acceleration gaps, and frequently is a limiting factor for the beam current which can be passed through the accelerator.

The arrangement of the embodiment of the invention shown in FIG. 2 substantially alleviates the problem of the prior art, because the gap voltage across each of the illustrated acceleration gaps is provided as a regulated voltage. Then, a beam strike current into one of the intermediate electrodes 12, 13, can be absorbed by the voltage regulated power delivery apparatus 44 with a much reduced effect on the d. c. output voltages from the voltage generators 26, 27 and 28. As a result, the accelerator of the embodiment of FIG. 2 can have substantially greater stability and consequently can be operated at higher beam powers.

As described above, the voltage regulation of the output voltages of the embodiment of FIG. 2 is conducted in the d. c. isolating power delivery apparatus 44. The d. c. isolating power delivery apparatus 44 provides input electric power on each of the pairs of input lines 35, 36, 37, 38 and 39, 40 which is voltage regulated, in which case the d. c. voltage generators 26, 27 and 28 are required only to generate the required d. c. output voltage corresponding to the required gap voltages which may be in direct proportion to the regulated input voltages.

Figure 3:
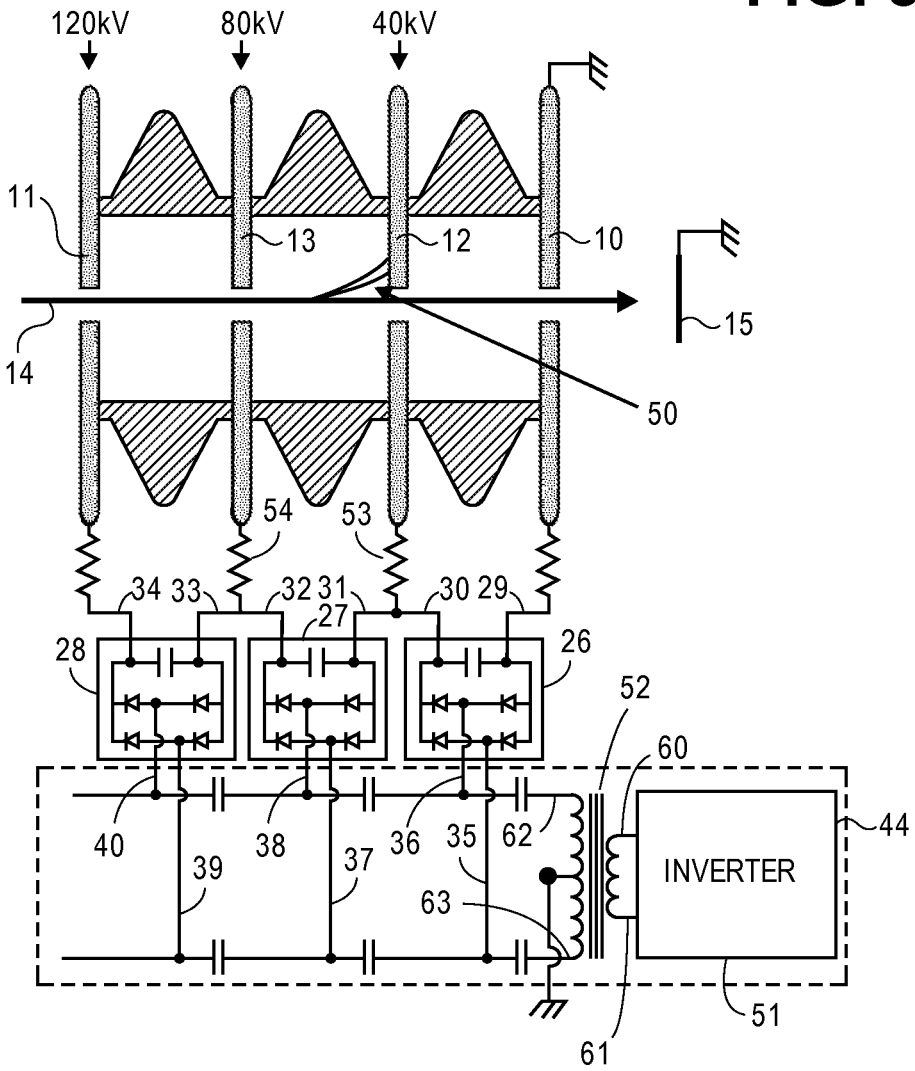
FIG. 3 is a schematic representation of a first embodiment of d. c. charged particle accelerator in accordance with the present invention.
Figure 4:
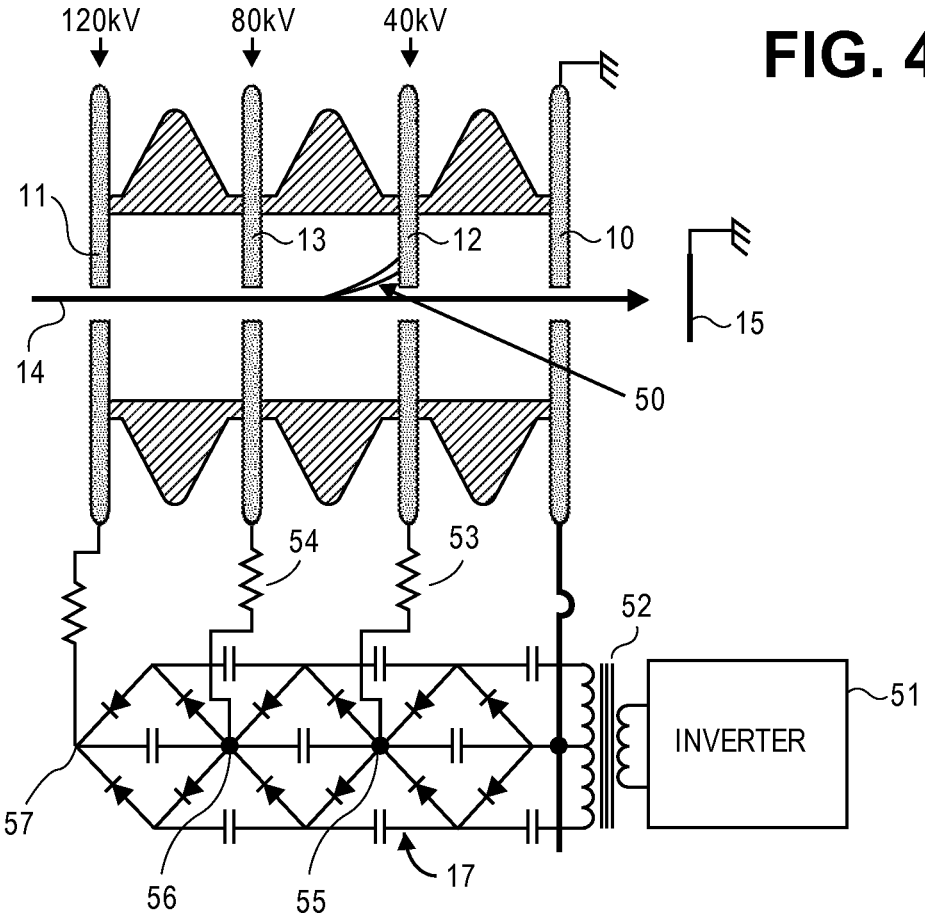
FIG. 4 is a schematic representation of the d. c. charged particle accelerator of FIG. 3, showing the power supply circuitry in alternative form.

An example of the invention is shown in FIGS. 3 and 4. In the embodiment of FIG. 3, the d. c. isolating power delivery apparatus 44 comprises an inverter 51, which may be fed from a ground referenced mains supply. Inverter 51 produces a high frequency a. c. supply connected to drive the primary winding of a step up transformer 52. The peak amplitude voltage of the high frequency supply from the inverter 51 which is supplied across end terminals 60, 61 of the primary winding of the transformer 52, is regulated by the inverter to a constant value. As a result, the peak to peak voltage produced between end terminals 62, 63 of the secondary winding of the step up transformer 52 is also maintained at a predetermined value. In the present embodiment where the desired gap voltage is 40 kV, the inverter 51 is arranged to provide a regulated high frequency output which, after stepping up by the transformer 52, produces a peak to peak voltage of 20 kV in each half of the centre tapped secondary winding of the step up transformer 52.

The regulated d. c. high voltage power supply apparatus shown in FIG. 3, is the same as that illustrated in FIG. 4, except in FIG. 4 that the elements of the d. c. isolating power delivery apparatus 44, and the d. c. voltage generators 26, 27 and 28 are redrawn to represent the more familiar CW voltage multiplier circuit. In fact, the circuit illustrated in FIG. 4, differs from the prior art arrangement of FIG. 1 only in that connections are taken from each stage of the CW multiplier directly (via resistances 53 and 54), to the intermediate electrodes 12 and 13 of the accelerator.

The CW multiplier illustrated in FIG. 4 has three stages corresponding to the number of acceleration gaps in the illustrated examples in FIGS. 3 and 4. The multiplier produces a d. c. voltage at a first stage point 55 which is equal to twice the peak to peak voltage on each half of the centre tapped secondary winding of the step up transformer 52. Since the voltage on the secondary winding of the step up transformer 52 is effectively regulated by the inverter 51, the d. c. voltage at a first stage point 55 in the CW multiplier is effectively a regulated d. c. voltage. Similarly, the voltage at the second stage point 56 in the CW multiplier is maintained at a regulated d. c. voltage equal to four times the peak to peak voltage of each half of the centre tapped secondary winding of the step up transformer 52. The d. c. voltage at the third stage point 57 of the CW multiplier is maintained at a regulated d. c. voltage equal to six times the peak to peak voltage from each half of the secondary winding of the step up transformer 52. In this way d. c. regulated voltages are provided at the appropriate voltage from each of the stage points 55, 56 and 57 for connection to electrodes 12, 13 and 14, so that the required gap voltages are provided.

As mentioned above the circuits of FIGS. 3 and 4 are functionally identical CW circuits. However the manner of drawing the CW circuit as shown in FIG. 3, illustrates how the circuit can be described as constituting the d. c. isolating power delivery apparatus 44 which delivers voltage regulated input electric power over pairs of lines 35 and 36, 37 and 38, 39 and 40 respectively to three d. c. voltage generators 26, 27, 28 (FIG. 3) which are d. c. isolated from each other. In this embodiment, the d. c. voltage generators each comprise four diodes in a full wave bridge circuit to produce a respective regulated high voltage d. c. output voltage on a respective pair of output lines 29 and 30, 31 and 32, 33 and 34. As illustrated in FIG. 3, the respective pairs of output lines 29 and 30, 31 and 32, 33 and 34 are connected to respective adjacent pairs of the accelerator electrodes 10 and 12, 12 and 13, 13 and 11, to provide gap voltages across the three acceleration gaps.

Referring again to the more familiar CW circuit layout of FIG. 4, to provide over current protection, the intermediate CW stage points 55 and 56 are connected to the respective intermediate electrodes 12 and 13 via current limiting resistors 53 and 54. However, the value of the current limiting resistors 53 and 54 may be much lower than the resistors of the potential divider 21 in the prior art arrangement, as these resistors should not be dissipating any electrical power in the absence of a beam strike on the electrodes. Accordingly resistance values for the resistors 53 and 54 of the order of 100 k ohm may be employed. Then a 1 mA current from intermediate electrode 12 resulting from beam strike 50 flowing through resistor 53 produces a voltage change on the electrode 12 of just 100V. Even the entire beam current (50 mA) striking electrode 12 and flowing through resistor 53 would produce a voltage change of 5 kV, compared to the nominal gap voltage of 40 kV for the accelerator. Accordingly, the embodiment described in FIGS. 3 and 4 can be much more resistant to the effect of beam strikes and therefore be operated at higher beam powers without excessive instability.

Embodiments of the invention have been described above by way of example. As discussed in relation to FIG. 2, the embodiments of FIGS. 3 and 4 having more gaps with a CW multiplier circuit having an appropriate number of additional stages.

The embodiment of the invention described above with reference to FIGS. 3 and 4 can provide a charged particle accelerator producing a high energy, high current beam which has good stability. The use of separate connections to stage points of the CW circuit for each acceleration gap can be expected also to enhance resistance to the Total Voltage Effect. Total Voltage Effect is the name given to the observed increasing tendency in accelerators for runaway breakdowns to occur at higher total energies.

In general, a variety of examples and embodiments have been provided for clarity and for completeness. Other embodiments of the invention will be apparent to one of ordinary skill in the art when informed by the present specification. Detailed methods of and system for accelerating charged particles have been described herein but any other methods and systems can be used within the scope of the invention. The foregoing detailed description has described only a few of the many forms that this invention can take. For this reason this detailed description is intended by way of illustration and not by way of limitation. It is only the following claims including all equivalents which are intended to define the scope of the invention.

The invention claimed is:

1. A d. c. charged particle accelerator comprising:

acceleration electrodes including end electrodes and at least N−1 intermediate electrodes, said acceleration electrodes defining at least N acceleration gaps between adjacent pairs of said electrodes, where N is at least three;

a Cockcroft Walton (CW) voltage multiplying circuit to provide, from a regulated a. c. driving voltage having a predetermined peak to peak value, a high voltage d. c. power supply, wherein said CW circuit has N stages providing N stage points each providing a respective d. c. voltage at a respective multiple (n) of said predetermined peak to peak value where n is 1, 2, . . . N; and a connection from each said stage point of the CW circuit to a respective one of said acceleration electrodes;

wherein said CW voltage multiplying circuit is a full-wave circuit.

2. A d. c. charged particle accelerator as claimed in claim 1, wherein each said connection between one of said stage points of the CW circuit and said respective one of said accelerator electrodes includes a respective current limiting resistor.

3. A d. c. charged particle accelerator as claimed in claim 1, wherein said CW circuit includes a step-up transformer having a primary winding and a secondary winding, each said winding having respective winding end terminals; and wherein said step-up transformer comprises:

an inverter connected to said primary winding and operative to supply a regulated a. c. voltage across the end terminals of said primary winding to produce an a. c. voltage between the end terminals of said secondary winding; and a voltage multiplier ladder formed of diodes and capacitors, and being connected to said secondary winding end terminals.

4. A method of accelerating charged particles using d. c. voltages, comprising the steps of:

providing acceleration electrodes including end electrodes and at least N−1 intermediate electrodes, said acceleration electrodes defining at least N acceleration gaps between adjacent pairs of said electrodes, where N is at least three; and a Cockcroft Walton (CW) voltage multiplying circuit to provide, from a regulated a. c. driving voltage having a predetermined peak to peak value, a high voltage d. c. power supply, wherein said CW circuit has N stages providing N stage points each providing a respective d. c. voltage at a respective multiple (n) of said predetermined peak to peak value where n is 1, 2, . . . N; and connecting each said stage point of the CW circuit to a respective one of said acceleration electrodes;

wherein said CW voltage multiplying circuit is a full-wave circuit.

5. A method as claimed in claim 4, wherein each of said stage points of the CW circuit is connected to a respective said electrode with a respective current limiting resistor.

6. A method as claimed in claim 4, wherein said CW circuit includes a step-up transformer having a primary winding and a secondary winding, each said winding having respective winding end terminals; and wherein said step-up transformer comprises:

an inverter connected to said primary winding and operative to supply a regulated a. c. voltage across the end terminals of said primary winding to produce an a. c. voltage between the end terminals of said secondary winding; and a voltage multiplier ladder formed of diodes and capacitors, and being connected to said secondary winding end terminals.

* * * * *